US009065218B2

(12) United States Patent
Scaffidi et al.

(10) Patent No.: US 9,065,218 B2
(45) Date of Patent: Jun. 23, 2015

(54) MAKING CONTACT IN A FORCE-OPTIMIZED MANNER BETWEEN ELECTRICAL LOADS AND PRINTED CIRCUIT BOARDS

(71) Applicant: Robert Bosch GmbH, Stuttgart (DE)

(72) Inventors: Sandro Scaffidi, Heiningen (DE); Jens Rudel, Schwieberdingen (DE); Peter Schubert-Heidt, Wurmberg (DE)

(73) Assignee: Robert Bosch GmbH, Stuttgart (DE)

( * ) Notice: Subject to any disclaimer, the term of this patent is extended or adjusted under 35 U.S.C. 154(b) by 192 days.

(21) Appl. No.: 13/671,126

(22) Filed: Nov. 7, 2012

(65) Prior Publication Data

US 2013/0115820 A1 May 9, 2013

(30) Foreign Application Priority Data

Nov. 8, 2011 (DE) ..... 10 2011 085 921

(51) Int. Cl.
*H01R 12/70* (2011.01)
*H01R 12/71* (2011.01)

(52) U.S. Cl.
CPC ..... *H01R 12/7023* (2013.01); *H01R 12/714* (2013.01)

(58) Field of Classification Search
USPC ..... 439/638, 67, 63, 493, 247
See application file for complete search history.

(56) References Cited

U.S. PATENT DOCUMENTS

| | | | | |
|---|---|---|---|---|
| 5,211,577 | A * | 5/1993 | Daugherty | 439/493 |
| 6,180,904 | B1 * | 1/2001 | Bauer et al. | 200/523 |
| 6,661,084 | B1 * | 12/2003 | Peterson et al. | 257/680 |
| 7,201,594 | B2 * | 4/2007 | van der Mee et al. | 439/247 |
| 7,442,047 | B1 * | 10/2008 | Schmidgall | 439/67 |
| 2011/0299232 | A1 * | 12/2011 | Schumann et al. | 361/679.01 |
| 2013/0115820 | A1 * | 5/2013 | Scaffidi et al. | 439/638 |

* cited by examiner

*Primary Examiner* — Alexander Gilman
(74) *Attorney, Agent, or Firm* — Maginot, Moore & Beck LLP

(57) ABSTRACT

A contact adapter for making contact in a force-optimized manner between an electrical load and a printed circuit board includes an electrically conductive contact element and an electrically non-conductive support structure. The electrically conductive contact element is configured to make an electrical contact between the printed circuit board and the electrical load. The support structure has a first supporting surface, which is configured to bear against a carrier plate of the printed circuit board. In this case, the contact element is integrated into the support structure in such a way that a first force exerted on the contact element by the electrical load is transferable to the carrier plate of the printed circuit board via the first supporting surface.

7 Claims, 3 Drawing Sheets

MAKING CONTACT IN A FORCE-OPTIMIZED MANNER BETWEEN ELECTRICAL LOADS AND PRINTED CIRCUIT BOARDS

This application claims priority under 35 U.S.C. §119 to patent application no. DE 10 2011 085 921.7, filed on Nov. 8, 2011 in Germany, the disclosure of which is incorporated herein by reference in its entirety.

BACKGROUND

Electrical control modules are used in many industrial sectors. For example, electrical control modules may be used in a transmission of a motor vehicle.

A printed circuit board may be provided in the electrical control modules. The printed circuit board may have a printed conductor substrate with electronic circuits and components connected by means of conductor tracks. In addition, contact points for electrical loads may be provided on the printed circuit board. The electrical loads may be supplied with current via a device connector of the control module.

If contact is made between the printed circuit board and the electrical load, the electrical load exerts a force on the printed circuit board. If said force exceeds a specific amount, the printed circuit board and the circuits and contacts located thereon may be damaged.

SUMMARY

There may therefore be a requirement for an improved and force-optimized manner of making contact between electrical loads and printed circuit boards.

This requirement can be covered by the subject matter of the present disclosure according to the independent claims. Advantageous embodiments of the present disclosure are described in the dependent claims.

Features, details and possible advantages of a device according to embodiments of the disclosure are discussed in detail in the following text.

According to a first aspect of the disclosure, a contact adapter for making contact in a force-optimized manner between an electrical load and a printed circuit board is presented. The contact adapter has an electrically conductive contact element and an electrically non-conductive support structure. The contact element is configured to make an electrical contact between the printed circuit board and the electrical load. The support structure has a first supporting surface, which is configured to bear against a carrier plate of the printed circuit board. In this case, the contact element is integrated into the support structure in such a way that a first force exerted on the contact element by the electrical load is transferable to the carrier plate of the printed circuit board via the first supporting surface.

To put it another way, the concept of the present disclosure is based on providing a contact adapter that can be arranged between the printed circuit board and the electrical load. Direct contact is therefore not made between the electrical load and the printed circuit board. In this case the contact adapter can both bridge a load-specific distance between the printed circuit board and the electrical load, and reduce or minimize a mechanical stress on the printed circuit board caused by the electrical load. In this case, the electrical contact is made via the electrically conductive contact element. In addition, a further mechanical contact is made between the electrically non-conductive support structure and a carrier plate on which the printed circuit board is arranged. In this case, the support structure is in contact with the carrier plate via a supporting surface and can absorb the first force exerted on the contact element by the electrical load and at least partially keep it away from the printed circuit board. Hence, the first force, which varies depending on the electrical load, cannot be transferred directly to the printed circuit board, as a result of which the printed circuit board is protected against damage.

Advantageously, the mechanical stress on the printed circuit board caused by electrical loads can be minimized in a cost-effective manner by means of the contact adapter according to the disclosure. The electrical properties of the contact between the printed circuit board and the electrical load are in this case retained or are not negatively influenced.

In this case, the electrical load may be, for example, an actuator, for instance an electro-hydraulic actuator, or a sensor. By way of example, the electrical load may be configured as a pressure-regulating valve, which regulates a hydraulic pressure in a hydraulic line of a transmission. In this case, the electrical load may have an electrical power of up to 20 watts.

The contact adapter has an electrically conductive contact element, which, for example, comprises a metal or an alloy. In particular, the contact adapter may consist of sheet copper and be configured to transfer a current provided by a control device connector in a manner as free from losses as possible. In this case, the contact element may be configured, for example, in a C shape and have a certain elasticity in order both to be insertable into the support element and able to exert a predefined first force on the printed circuit board. Depending on the ambient conditions, the contact element may have different coatings, in particular at the interfaces with the printed circuit board and with the electrical load.

The contact adapter may have a plurality of separate contact elements, in particular two. In this case, a first contact element can be connected to a positive pole and a second contact element can be connected to a negative pole of a power source. In this way, the electrical load connected to the printed circuit board by means of the contact adapter can be supplied with power. Alternatively, the contact adapter may have just one contact element, with the result that two contact adapters are used for one electrical load. In this case, a first contact adapter can be connected to a positive pole and a second to a negative pole.

The contact element is inserted or integrated into an electrically non-conductive support structure. In this case, the support structure may comprise, for example, plastic and/or ceramic. The support structure may, for example, be configured as a support or carrier frame and have a first supporting surface. By way of example, the supporting surface may be circumferential or consist of a plurality of individual surfaces. If the contact adapter makes an electrical contact with the printed circuit board, that is to say if the former is mounted on the printed circuit board, then the first supporting surface bears against a carrier plate of the printed circuit board. In the mounted state, the supporting surface runs parallel to the carrier plate. In this case, the supporting surface ensures that, irrespective of a first force exerted on the contact adapter, a specific distance is maintained between the electrical load and the printed circuit board and hence also that the force exerted on the printed circuit board is minimized.

The carrier plate, on which the printed circuit board is arranged, is connected to further components, for instance to a control module housing. The first force is transferred from the electrical load to the contact adapter and transmitted to the carrier plate via the first supporting surface of the support structure. In this case, the first force can also be passed on from the carrier plate to the surrounding components. This may take place, for example, via fastening points, for instance screw-attachment points of the carrier plate on the control module housing.

The carrier plate may be configured, for example, as an aluminum plate and have a cutout, through which the contact element makes contact with the printed circuit board. In the mounted state of the contact adapter, the carrier plate is therefore located between the printed circuit board and the first supporting surface, with the result that the first force is not transferred or is only partially transferred to the printed circuit board.

According to one exemplary embodiment of the disclosure, the contact element is configured to exert a second force on the printed circuit board. The second force is in this case substantially independent of the first force. In this way it can be ensured that the electrical properties of the electrical contact between the printed circuit board and the electrical load correspond to a predefined standard.

In this case, substantially independent may mean that the amount of the second force can be proportionally influenced by at most 30%, in particular at most 10% and preferably at most 5%. Alternatively, the second force may be completely independent of the first force.

According to a further exemplary embodiment, the contact element has a first interface with the printed circuit board and a second interface with the electrical load. In this case, the support structure has a second supporting surface, which is arranged such that the first force acting on the second interface of the contact element is absorbed by the second supporting surface and is transferred to the first supporting surface.

The first and second interfaces may in each case be configured as surfaces. In the inserted or mounted state, these surfaces may run parallel to the printed circuit board and parallel to one another. The first and second interfaces may be connected to one another, for example by means of one or more electrically conductive and elastic connection elements. The first interface may make an electrical contact with the printed circuit board or with a contact located thereon. For this purpose, the first interface may be configured as a spring contact, solder contact, welded contact or plug contact. Preferably the first interface is configured as a solder contact or spring contact.

The second interface may make an electrical contact with the electrical load. For this purpose, the second interface may be configured as one of the types of contacts described in connection with the first interface. In this case, the second interface may be configured as a separable contact, in particular as a spring contact or as an insulation-displacement contact. An insulation-displacement contact may in this case be a separable cold-contacting connection. In this case, the first and second interfaces may have the same or a different type of contact. By way of example, the first interface may be configured as a solder contact and the second interface may be configured as a spring contact.

The embodiment of the first and second interfaces as a spring or plug contact may be particularly advantageous and ensure a particularly reliable electrical contact, even in the event of strong vibrations. The embodiment as a spring contact or a plug contact is possible thanks to the contact adapter according to the disclosure, since it can be produced for individual electrical loads rather than for groups of loads, and thus a better compensation of manufacturing tolerances is possible.

According to a further exemplary embodiment, the contact element is configured separately from the support structure. The contact element has a fixing element which is configured to fix the contact element in the support structure.

To put it another way, the contact element is not configured to be integral with the support structure, for example. During the manufacture of the contact adapter, the support structure and the contact element can be produced separately from one another and subsequently joined together. The contact element has a fixing element, for example between the first and second interfaces, for fastening and fixing the contact element to the support structure. The fixing element may be configured as a barb or latching tab and engage in a corresponding cutout in the support structure. By way of example, the fixing element may be configured in a spring-like manner, in particular as a leaf spring. During assembly, the fixing element may firstly be overtensioned in one direction in order to insert the contact element into the support structure. Then the fixing element is relieved of loading and supported on the support structure or the cutout provided therein.

According to a further exemplary embodiment, the support structure has a positioning pin. The positioning pin is configured to align the support structure on a positioning element of the carrier plate. In this case, the support structure may have a plurality of positioning pins, which are arranged on a side of the support structure facing the carrier plate. A first positioning pin may, for example, be arranged at one corner and a second positioning pin may be arranged at a diagonally opposite corner of the support structure. The positioning element on the carrier plate may, for example, be a cutout which corresponds to the cross section of the positioning pin. A separate positioning element may be provided for each positioning pin.

According to a further exemplary embodiment, the support structure has a latching hook. In this case the latching hook is configured to engage in the carrier plate of the printed circuit board and thereby fix the contact adapter to the carrier plate. The support structure may have a plurality of latching hooks. In this case, corresponding latching elements, for instance cutouts with a projection, may be provided in the carrier plate. The latching elements may be configured to receive the latching hooks and to prevent the latching elements from being released from the carrier plate without the use of force.

According to a second aspect of the disclosure, an electrical control module is presented. The control module has a printed circuit board, a carrier plate, a housing and an above-mentioned contact adapter. The contact adapter is configured to make an electrical contact between an electrical load and the printed circuit board. The printed circuit board is arranged on the carrier plate and at least partially surrounded by the housing. In this case, the carrier plate is fastened to the housing. The contact adapter is configured to transfer a first force exerted on the contact element by the electrical load to the carrier plate. The carrier plate transfers said first force to the housing, for example at fastening points, with the result that the first force is not transferred directly to the printed circuit board and hence said printed circuit board is protected from damage by load-specific variations in the first force.

The printed circuit board of the control module has electrical contacts and components. In addition, the printed circuit board has a device connector, which is connected to an energy source, for instance to a battery or a generator. The printed circuit board is fastened to a carrier plate, which is configured as an aluminum plate, for example. In the mounted state of the contact adapter, the carrier plate is arranged between the printed circuit board and the contact adapter. In this case, the carrier plate has a cutout, through which the contact adapter makes contact with the printed circuit board.

A control module may have a plurality of contact adapters. In this case, just one contact adapter may be provided per electrical load. In this way, manufacturing tolerances of the individual electrical loads can be better compensated. In contrast to earlier large-area group adapters for a multiplicity of electrical loads, spring contacts and plug contacts are possible at the first interface between the contact adapter and the printed circuit board thanks to the device according to the disclosure.

Both the contact adapter and the electrical control module may be used in a motor vehicle, for instance in an automobile or in a truck. In particular, the contact adapter may be used in a transmission control module of a truck.

BRIEF DESCRIPTION OF THE DRAWINGS

Further features and advantages of the present disclosure will become apparent to a person skilled in the art from the following description of exemplary embodiments, which should not, however, be interpreted as being restrictive to the disclosure, with reference to the attached drawings.

DETAILED DESCRIPTION

Figure 1:
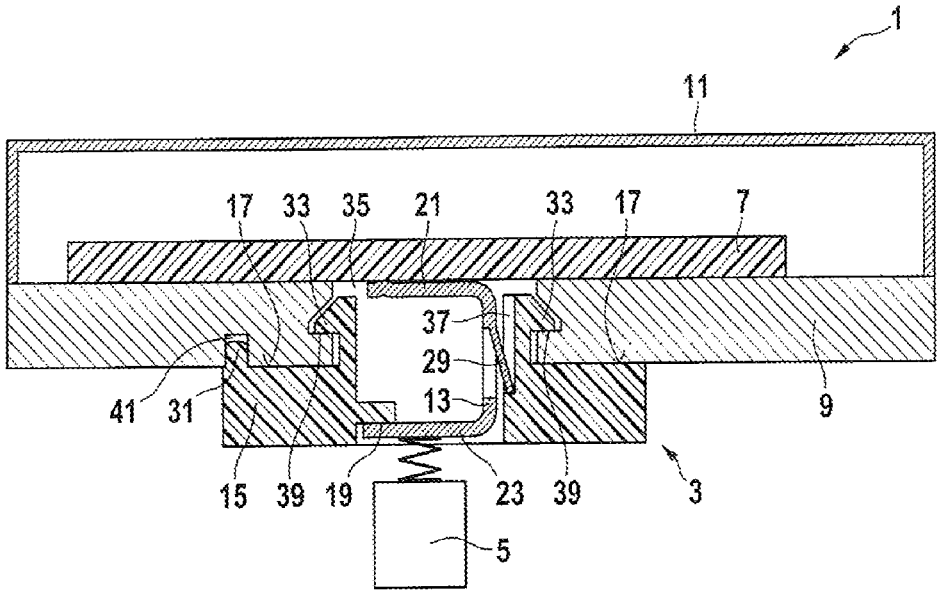
FIG. 1 shows a cross section through an electrical control module according to one exemplary embodiment of the disclosure

All the figures are merely schematic illustrations of devices according to the disclosure or constituent parts of said devices according to exemplary embodiments of the disclosure. In particular, distances and relative sizes are not reproduced to scale in the figures. Corresponding elements are provided with the same reference numerals in the various figures.

If a printed circuit board 7 of an electrical control module 1 is connected to an electrical load 5, either directly or by means of a conventional contact, then the electrical load 5 exerts mechanical forces on the printed circuit board 7. These forces cannot be absorbed by the printed circuit board 7.

FIG. 1 illustrates an electrical control module 1, the printed circuit board 7 of which is electrically connected to the electrical load 5 by means of a contact adapter 3. The fact that the control module 1 is equipped with a carrier plate 9 and the use of the contact adapter 3 contribute to minimizing the mechanical stress on the printed circuit board 7 by the electrical load 5. In this case, the electrical properties are not impaired in comparison with conventional contact methods.

The control module 1 has a printed circuit board 7, which is arranged on a carrier plate 9, in particular on an aluminum plate. A housing 11 at least partially surrounds the printed circuit board 11. The carrier plate 9 is fastened to the housing 11. A cutout 35 is provided in the carrier plate 9, through which cutout the contact adapter 3 is able to make contact with the printed circuit board 7 from below. In addition, the control module 1 may have a device connector, which produces a connection to a current source or power source. The device connector is not shown in the figures.

The contact adapter 3 is arranged between the printed circuit board 7 and the electrical load 5 and has an electrically conductive contact element 13 and an electrically non-conductive support structure 15. The contact element 13 has a first interface 21 with the printed circuit board 7 and a second interface 23 with the electrical load 5. In this case, the first interface 21 is configured as a solder contact. The second interface 23 is configured as a spring contact in FIG. 1. In addition, the contact element 13 has a fixing element 29, which is configured as a leaf spring-like barb. Thanks to the fixing element 29, the contact element 13, which is produced separately from the support structure 15, can be fastened in the support structure 15. During the manufacture of the contact adapter 3, the fixing element 29 can firstly be overtensioned, for example manually to the left (in FIG. 1), with the result that the contact element 13 can be inserted into the support structure 15. Then the fixing element 29 is relieved of loading, with the result that it is supported on the support structure 15. In particular, a first receiving element 37, in which the fixing element engages, is provided in the support structure 15. The first receiving element 37 is configured as a cutout in the exemplary embodiment in FIG. 1.

The support structure 15 has positioning pins 31, which, in conjunction with positioning elements 41 on the carrier plate 9, serve to align the contact adapter 3 on the carrier plate 9. The positioning elements 41 are configured as cutouts in the illustrated exemplary embodiment. In addition, the support structure 15 has latching hooks 33, which are configured to engage in second receiving elements 39 on the carrier plate 39 and, in this way, fasten or fix the contact adapter 3 to the carrier plate 9.

If an electrical load 5 is connected to the printed circuit board 7 by means of the contact adapter 3, the electrical load 5 exerts a first force 25 (shown in FIG. 3) on the second interface 23 of the contact element 13. The second interface 23 is supported on a second supporting surface 19 of the support structure 15, with the result that the first force 25 is transferred from the contact element 13 to the support structure 15. The support structure 15 has an additional first supporting surface 17, which bears against the carrier plate 9 from below. The first force 25 is transferred via said first supporting surface 17 from the contact adapter 3 to the carrier plate 9 and from there, for example, via a fastening or screw-attachment point to the housing 11 and further components. In this way, the printed circuit board 7 can be protected from excessively high force influences.

In order to make the electrical contact between the printed circuit board 9 and the electrical load 5, the contact element 13 exerts a second force 27, which is independent of the first force 25 to the greatest extent, on the printed circuit board 9. The distribution of forces is illustrated in FIG. 3.

Figure 2:
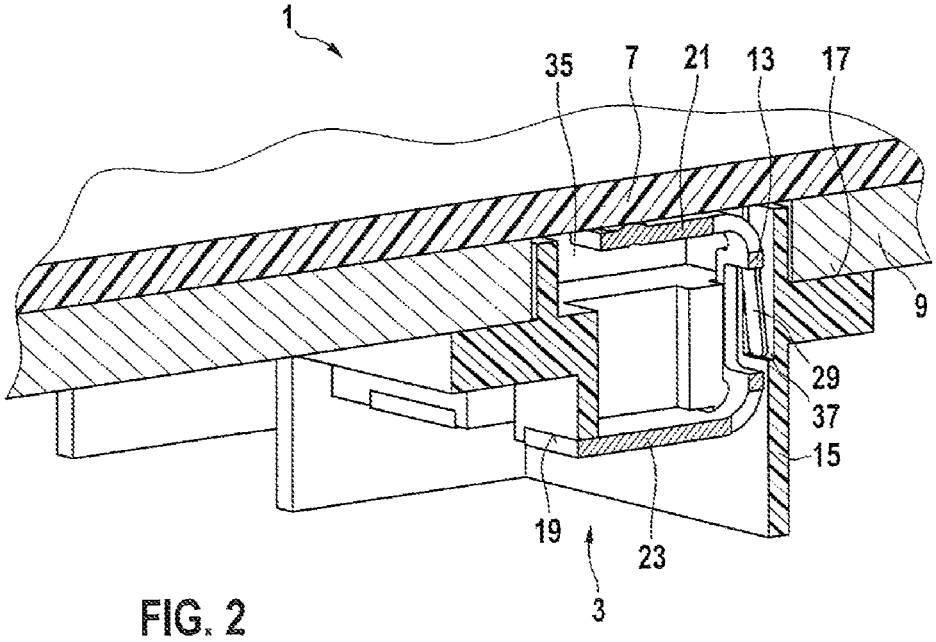
FIG. 2 shows a perspective view of the electrical control module shown in FIG. 1
Figure 3:
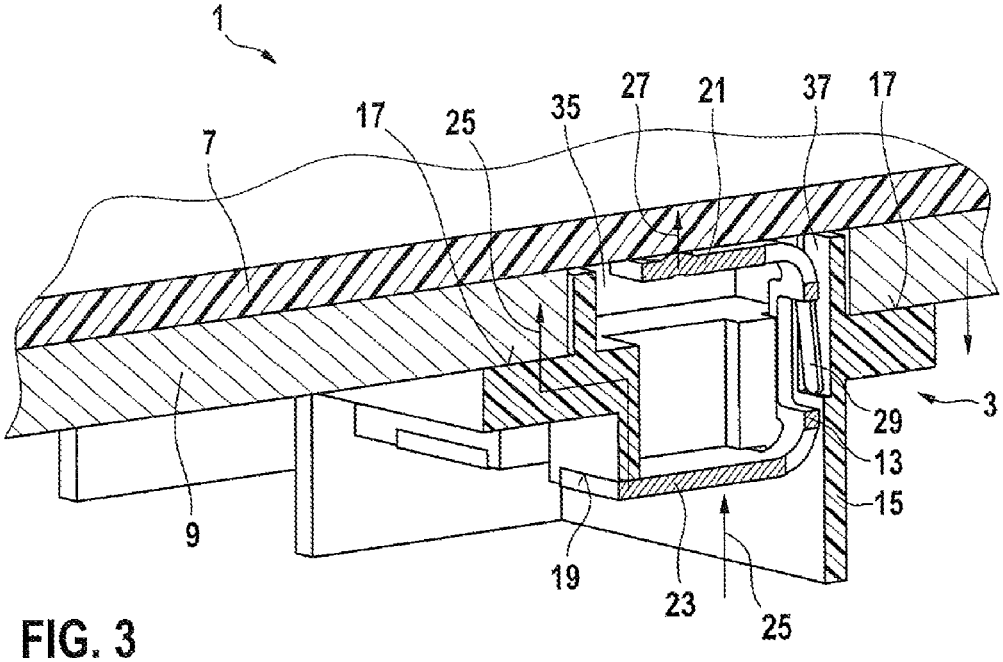
FIG. 3 shows a distribution of forces through the contact adapter and the carrier plate

In this case, a perspective view of the electrical control module 1 shown in FIG. 1 is illustrated in FIGS. 2 and 3. The section runs along a different section plane than in FIG. 1.

Figure 4:
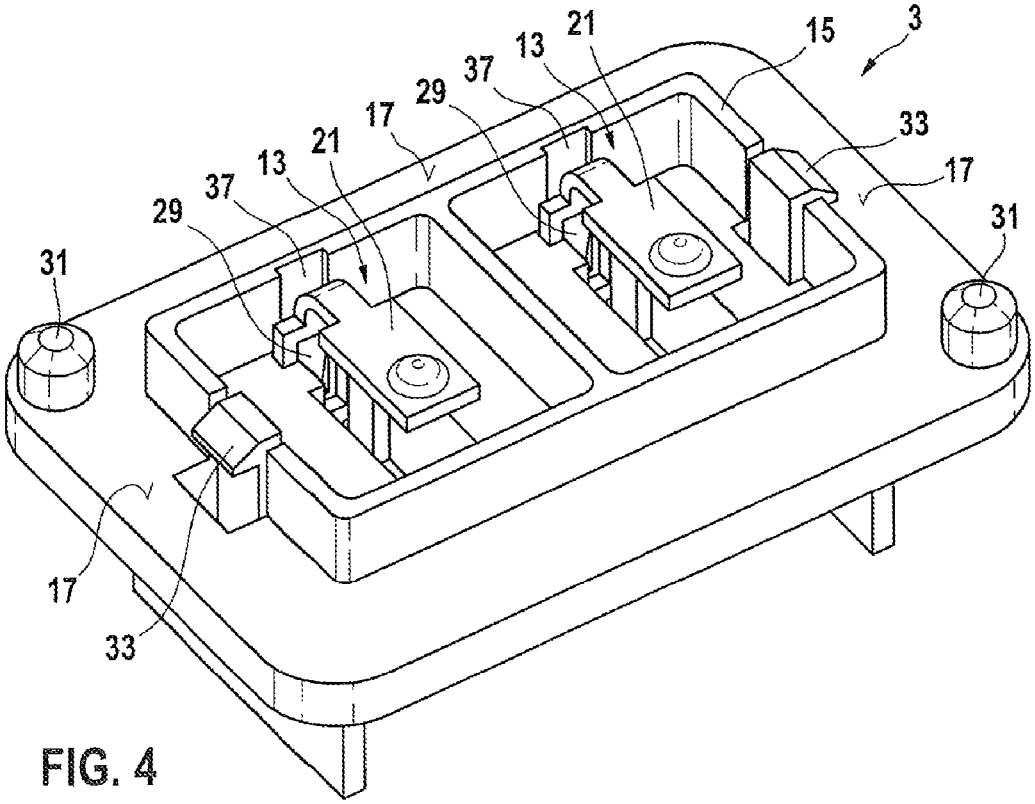
FIG. 4 shows a plan view of the contact adapter according to one exemplary embodiment of the disclosure
Figure 5:
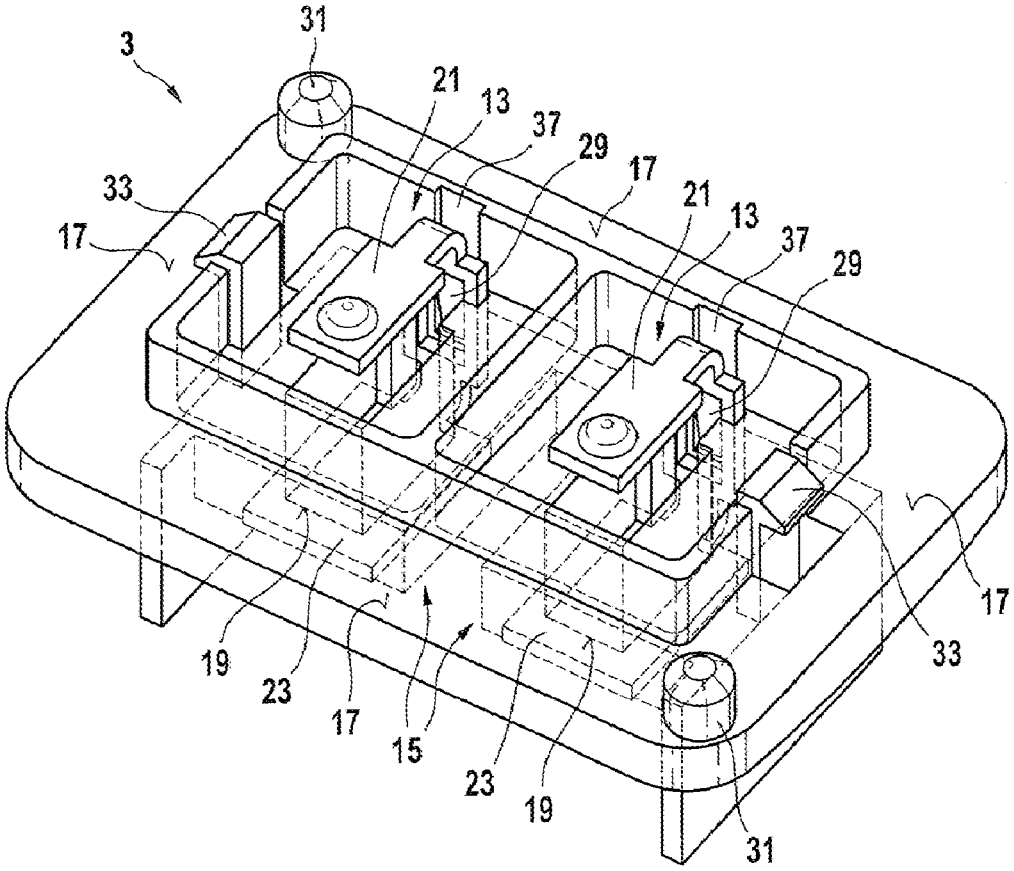
FIG. 5 shows a plan view of the contact adapter with a transparent support structure according to one exemplary embodiment of the disclosure.

FIGS. 4 and 5 show an exemplary embodiment of a contact adapter 3. In this case, the contact adapter 3 in FIG. 2 to 5 is configured with two contact elements 13 for an electrical load 5. The plan view in FIG. 5 is illustrated in parts as being transparent. In the exemplary embodiments in FIGS. 4 and 5, the positioning pins 31 are arranged at diagonally opposite corners of the support structure 15. The latching hooks 33 are arranged on opposite sides over the first supporting surface 17 of the support structure 15.

Finally, it should be noted that expressions such as "having" or the like are not intended to rule out the possibility of further elements or steps being provided. Furthermore, it should be pointed out that the use of "one" or "a" is not intended to rule out a greater number. In addition, features described in connection with the various embodiments can be combined with one another as desired. It should also be noted that the reference numerals in the claims are not intended to be interpreted as being restrictive to the scope of the claims.

What is claimed is:

1. A contact adapter for making contact in a force-optimized manner between an electrical load and a printed circuit board, comprising:

an electrically conductive contact element, which is configured to make an electrical contact between the printed circuit board and the electrical load; and a support structure including (i) an electrically non-conductive material, and (ii) a first supporting surface, which is configured to bear against a carrier plate of the printed circuit board, wherein the electrically conductive contact element is integrated into the support structure in such a way that a first force exerted on the electrically conductive contact element by the electrical load is transferable to the carrier plate of the printed circuit board via the first supporting surface;

wherein the electrically conductive contact element has a first interface with the printed circuit board and a second interface with the electrical load; and wherein the support structure has a second supporting surface, which is arranged such that the first force acting on the second interface of the electrically conductive contact element is absorbed by the second supporting surface and is transferred to the first supporting surface.

2. The contact adapter according to claim 1, wherein:

the electrically conductive contact element is configured to exert a second force on the printed circuit board, and the second force is independent of the first force.

3. The contact adapter according to claim 1, wherein:

the first interface is configured as a spring contact or as a solder contact, and the second interface is configured as a spring contact or as an insulation-displacement contact.

4. The contact adapter according to claim 1, wherein:

the electrically conductive contact element is configured separately from the support structure, and the electrically conductive contact element has a fixing element, which is configured to fix the contact element in the support structure.

5. The contact adapter according to claim 1, wherein:

the support structure includes a positioning pin, and the positioning pin is configured to align the support structure on a positioning element on the carrier plate.

6. The contact adapter according to claim 1, wherein:

the support structure has a latching hook, and the latching hook is configured to engage in the carrier plate of the printed circuit board and thereby fix the contact adapter to the carrier plate.

7. An electrical control module, comprising:

a printed circuit board;

a housing, in which the printed circuit board is arranged;

a carrier plate on which the printed circuit board is arranged and which is fastened to the housing;

a contact adapter including (i) an electrically conductive contact element and (ii) a support structure including an electrically non-conductive material, and a first supporting surface, which bears against the carrier plate, wherein the contact adapter is configured to make an electrical contact between an electrical load and the printed circuit board; and wherein the contact adapter is configured to transfer a first force exerted on the electrically conductive contact element by the electrical load to the carrier plate.

* * * * *